US009051033B2

(12) United States Patent
Alphin

(10) Patent No.: US 9,051,033 B2
(45) Date of Patent: Jun. 9, 2015

(54) PADDLEBOARD STORAGE AND SEAT SUPPORT ASSEMBLY

(71) Applicant: Kent Alphin, Wilmington, NC (US)

(72) Inventor: Kent Alphin, Wilmington, NC (US)

( * ) Notice: Subject to any disclaimer, the term of this patent is extended or adjusted under 35 U.S.C. 154(b) by 0 days.

(21) Appl. No.: 14/317,419

(22) Filed: Jun. 27, 2014

(65) Prior Publication Data

US 2014/0305364 A1 Oct. 16, 2014

Related U.S. Application Data

(63) Continuation-in-part of application No. 13/803,806, filed on Mar. 14, 2013.

(60) Provisional application No. 61/840,974, filed on Jun. 28, 2013.

(51) Int. Cl.
*B63B 35/79* (2006.01)

(52) U.S. Cl.
CPC ..... *B63B 35/7946* (2013.01)

(58) Field of Classification Search
CPC B63B 35/7909; B63B 35/7906; B63B 35/74; B63C 9/08
USPC ..... 441/74, 363
See application file for complete search history.

(56) References Cited

U.S. PATENT DOCUMENTS 3,377,007 A * 4/1968 Gayler, Jr. ..... 224/609
4,452,161 A * 6/1984 McCoy ..... 114/39.18
4,623,316 A * 11/1986 Ratliff ..... 441/106
4,745,870 A * 5/1988 Roth ..... 114/39.18
4,795,381 A * 1/1989 Willems ..... 440/26
4,804,025 A * 2/1989 Bear ..... 224/604
4,894,035 A * 1/1990 Pia ..... 441/79
5,179,942 A * 1/1993 Drulias et al. ..... 128/101.1
5,569,057 A * 10/1996 Barsdorf et al. ..... 441/65
5,643,184 A * 7/1997 Toso ..... 602/19
D390,001 S * 2/1998 Lovelady et al. ..... D3/221
5,820,430 A * 10/1998 Hornsby et al. ..... 441/65
5,860,944 A * 1/1999 Hoffman, Jr. ..... 602/19
6,129,691 A * 10/2000 Ruppert ..... 602/19
6,213,831 B1 * 4/2001 Smith ..... 441/65
6,227,925 B1 * 5/2001 Boddy ..... 441/129
6,319,217 B1 * 11/2001 Darcey ..... 602/19
6,436,065 B1 * 8/2002 Mitchell ..... 602/19
7,798,877 B1 * 9/2010 Wortham ..... 441/79
7,931,571 B2 * 4/2011 Bernardoni ..... 482/124
8,088,088 B2 * 1/2012 Hurley ..... 602/18
8,336,475 B2 * 12/2012 Morin ..... 114/39.22
8,696,396 B1 * 4/2014 Churchill et al. ..... 441/66
2006/0046589 A1 * 3/2006 Farley et al. ..... 441/108

* cited by examiner

*Primary Examiner* — Lars A Olson
*Assistant Examiner* — Jovon Hayes

(57) ABSTRACT

A paddleboard storage and seat support assembly stores items on a paddleboard, supports a person in an upright seated position on the paddleboard, and provides support for carrying the paddleboard while walking. The assembly includes a panel and a cord having a first end and a second end. Each of the first end and the second end is coupled to a respective end of the panel. Each of a pair of foot straps is couplable to the panel such that respective looped ends of the foot straps are positioned in spaced relationship to the panel for engaging feet of a user while the panel is positioned against a back of the user such that the panel supports the back of the user in an upright seated position.

12 Claims, 5 Drawing Sheets

PADDLEBOARD STORAGE AND SEAT SUPPORT ASSEMBLY

CROSS-REFERENCE TO RELATED APPLICATIONS

This application claims benefit of the provisional application 61/840,974 filed on Jun. 28, 2013. This application is also a continuation in part of non-provisional application Ser. No. 13/803,806 filed on Mar. 14, 2013.

BACKGROUND OF THE DISCLOSURE

Field of the Disclosure

The disclosure relates to storage devices and more particularly pertains to a new storage device for storing items on a paddleboard, supporting a person in an upright seated position on the paddleboard, and providing support for carrying the paddleboard while walking.

SUMMARY OF THE DISCLOSURE

An embodiment of the disclosure meets the needs presented above by generally comprising a panel and a cord having a first end and a second end. Each of the first end and the second end is coupled to a respective end of the panel. Each of a pair of foot straps is couplable to the panel such that respective looped ends of the foot straps are positioned in spaced relationship to the panel for engaging feet of a user while the panel is positioned against a back of the user such that the panel supports the back of the user in an upright seated position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
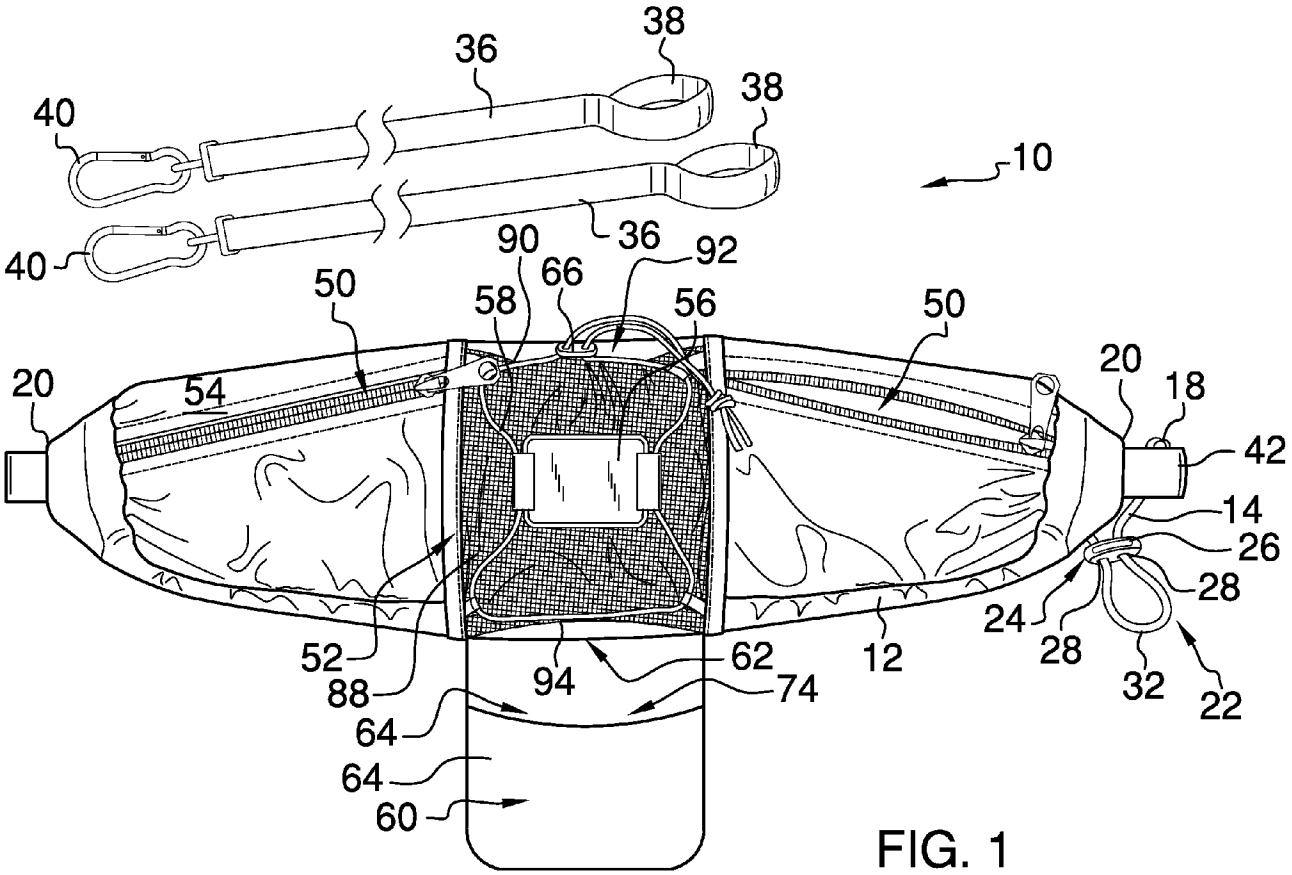
FIG. 1 is a front view of a paddleboard storage and seat support assembly according to an embodiment of the disclosure.

With reference now to the drawings, and in particular to FIGS. 1 through 7 thereof, a new storage device embodying the principles and concepts of an embodiment of the disclosure and generally designated by the reference numeral 10 will be described.

Figure 2:
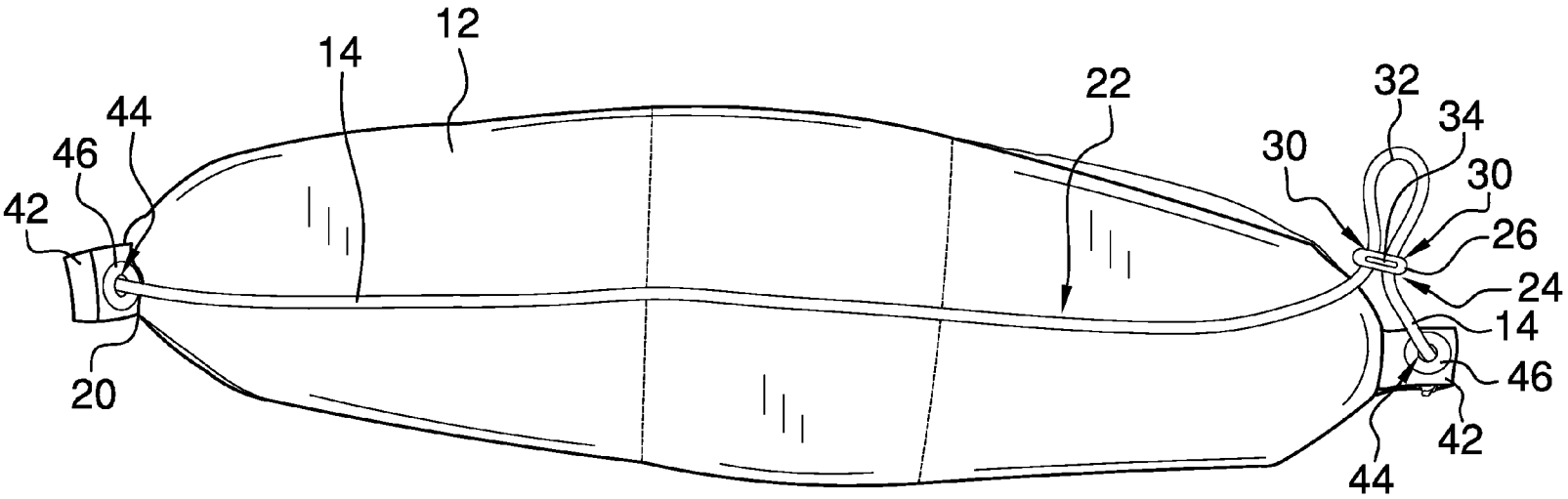
FIG. 2 is a back view of an embodiment of the disclosure.
Figure 3:
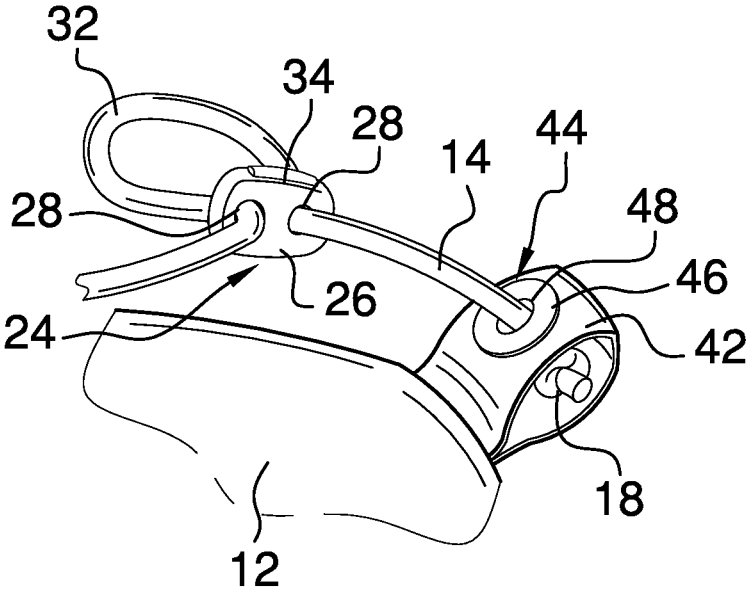
FIG. 3 is a detailed back view of a cord lock of an embodiment of the disclosure.
Figure 4:
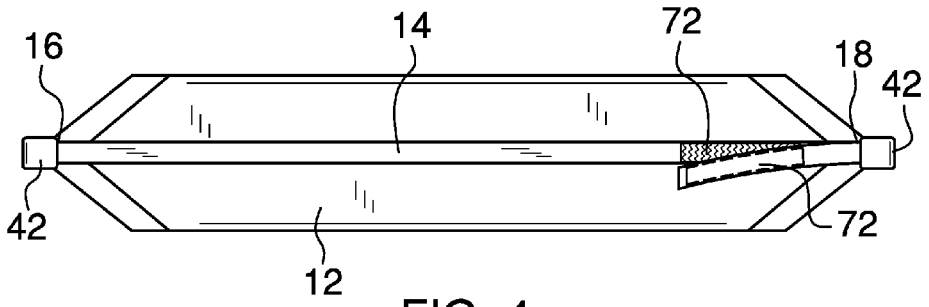
FIG. 4 is a back view of an embodiment of the disclosure.

As best illustrated in FIGS. 1 through 7, the paddleboard storage and seat support assembly 10 generally comprises a panel 12. A cord 14 has a first end 16 and a second end 18. Each of the first end 16 and the second end 18 is coupled to a respective end 20 of the panel 12. The cord 14 may be a shock cord 22 wherein a length of the cord 14 is resilient and stretchable between the first end 16 and the second end 18. The cord 14 may alternatively be webbing or the like provided with a mechanism for adjusting a length of the cord 14. As shown in FIG. 4, the cord 14 may have hook and loop fastener 72 such that the second end 18 of the cord 14 is formed by folding the cord 14 over and engaging the hook and loop fastener forming a desired length for the cord 14.

As shown in FIGS. 1 through 3, a cord lock 24 is coupled to the cord 14 wherein an effective length of the cord 14 extending between the opposite ends 20 of the panel 12 is adjustable. The cord lock 24 is a tab 26 or housing having a pair of spaced holes 28. The cord 14 extends through the spaced holes 28 such that the tab 26 engages a pair of spaced points 30 on the cord 14 wherein a section 32 of the cord 14 extending between the spaced holes 28 is removable from the effective length of the cord 14 extending between the opposite ends 20 of the panel 12. A biased trigger 34 of conventional design may be coupled to the tab 26 to engage the cord 14 further inhibiting slippage of the cord 14 relative to the tab 26.

Each of a pair of foot straps 36 has a looped end 38. Each of the foot straps 36 is couplable to the panel 12 such that looped ends 38 of the foot straps 36 are positioned in spaced relationship to the panel 12. Thus, the looped ends 38 of the foot straps 36 are configured for engaging feet of a user while the panel is positioned against a back of the user. Tension between the looped ends 38 of the foot straps 36 and the panel 12 supports the back of the user in an upright seated position. Each of the foot straps 36 has an adjustable length through conventional structures such as buckles or the like. Each of a pair of clips 40 is coupled to an associated one of the foot straps 36 at a proximal end 42 of the foot strap 36 opposite the looped end 38 wherein the clips 40 are positioned to secure the foot straps 36 to the panel 12.

Each of a pair of loops 42 is coupled to the panel 12. Each of the loops 42 is coupled to and extends away from an associated one of the respective ends 20 of the panel 12. Each of the first end 16 and the second end 18 of the cord 14 is coupled to an associated one of the loops 42. More particularly, each of the loops 42 has a respective aperture 44 extending therethrough. The cord 14 extends through the aperture 44 in each of the loops 42. The first end 16 of the cord 14 and the second end 18 of the cord 14 are each knotted such that each of the first end 16 and the second end 18 of the cord 14 is inhibited from passing through the associated one of the apertures 44. Thus, the cord 14 is coupled to the panel 12 allowing the panel to be worn around a user's waist or attached to a paddleboard when the panel 12 is not being used to support the user's back. Each of a pair of grommets 46 is coupled to an associated one of the loops 42 such that each grommet 46 reinforces a perimeter edge 48 extending around the aperture 44 extending through the associated loop 42.

At least one pocket 50 is coupled to the panel 12. The pocket 50 may have a closure such as a zipper or the like. Additionally, the pocket 50 may be waterproof or otherwise resistant to being saturated by water during use. Each of the foot straps 36 is positionable in the pocket 50 for storage of the foot straps 36 when not in use. The pocket 50 may be one of two pockets 50 arranged on opposite sides of a central section 52 of a front face 54 of the panel 12.

A flexible sheet 56 may be coupled to the panel 12 by a resilient line 58 allowing the sheet 56 to be pulled away from the front face 54 of the panel 12. The line 58 urges the sheet 56 back against the front face 54. The sheet 56 may be used to secure items against the panel 12 including the foot straps 36, leaving the pocket 50 free for storage of other items. A clip 66 or the like may be coupled to the line 58 to adjust tension in the line to facilitate securing items using the sheet 56.

A central pocket 88 formed by mesh is positioned over the central section 52 of the panel 12. The central pocket 88 has an elastic top opening 90 aligned with a top section 92 of the line 58 such that the line 58 facilitates retention of objects within the central pocket 88 when the line 58 is tightened. The foot straps 36 may also be stored in the central pocket 88.

A flap 60 may have an edge 62 coupled to the panel 12 adjacent to and aligned with the sheet 56 and a bottom edge 94 of the central pocket 88. The flap 60 may comprise a pair of substantially coextensive walls 64 and a closed bottom opposite the edge 62. The walls 64 form an opening 74 directed towards edge 62 allowing the flap 60 to hold an item adjacent to the sheet 56. Thus, a container such as a bottle or the like may be seated in the flap 60 and positioned to extend between the panel 12 and the sheet 56 whereby the sheet 56 holds the container in a substantially parallel orientation to the panel 12. Alternatively, the sheet 56 may be extended from the panel 12 and a container such as a beverage can may be positioned between the sheet 56 and the panel 12 such that the beverage can is oriented substantially transversely relative to the panel 12. The sheet 56 is solid to abut and cover an open top of the beverage can. Thus, the sheet 56 is configured to hold the beverage can in an upright position when the panel 12 is coupled to a paddleboard in a horizontal position. The flap 60 may be folded under the sheet 56 and the central pocket 88 such that the flap 60 is positioned between the central pocket 88 and the panel 12 when not in use.

Figure 5:
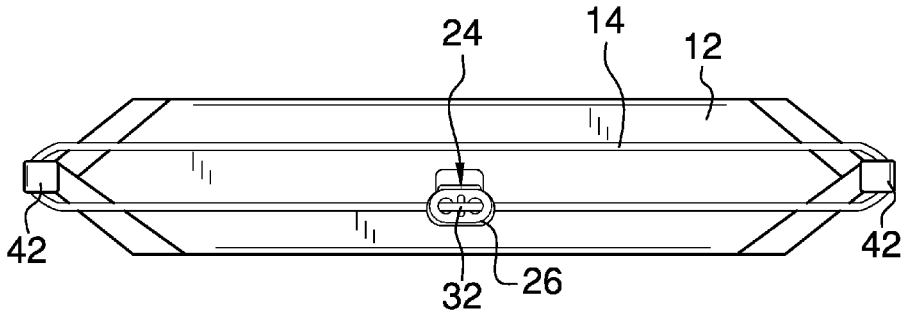
FIG. 5 is a back view of an embodiment of the disclosure.
Figure 6:
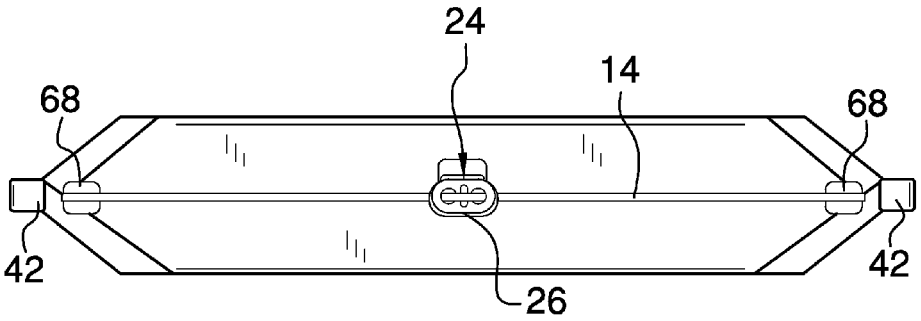
FIG. 6 is a back view of an embodiment of the disclosure.
Figure 7:
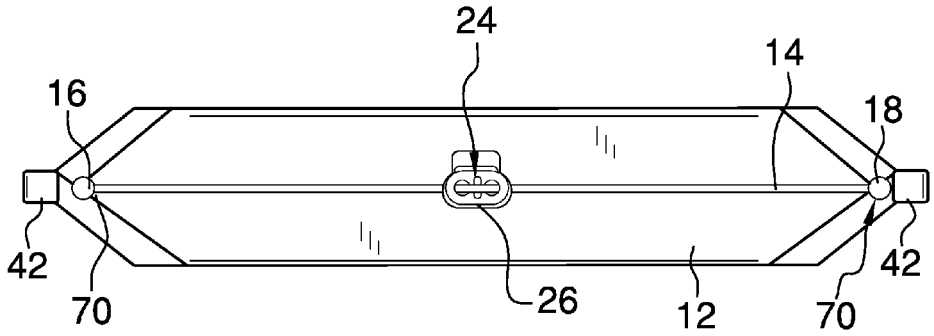
FIG. 7 is a back view of an embodiment of the disclosure.

Alternative methods of attaching the cord 14 to the panel 12 may be employed including the cord 14 being a ring extending through the loops 42 as shown in FIG. 5. As shown in FIG. 6, additional loops 68 may be provided allowing separate connections at each of the opposite ends 20 of the panel 12 for the foot straps 36 and the cord 14. The method of cord attachment shown in FIG. 5 may also be employed with the additional loop structure shown in FIG. 6. The cord 14 may also be secured to the panel 12 directly through holes 70 extending through the panel 12 as shown in FIG. 7.

In use, the cord 14 provides for securing the panel 12 to the paddleboard for storage of items while using the paddleboard. The cord 14 can also be used to secure the panel 12 around the waist of the user. The foot straps 36 may be interlocked in a conventional manner and clipped to the panel 12 while the panel 12 is secured to the paddleboard to form a sling to facilitate carrying of the paddleboard.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A paddleboard seat support assembly comprising:

a panel;

a cord having a first end and a second end, each of said first end and said second end being coupled to a respective end of said panel; and a pair of foot straps, each foot strap having a respective looped end, each of said foot straps being couplable to said panel such that looped ends of said foot straps are positioned in spaced relationship to said panel wherein said looped ends of said foot straps are configured for engaging feet of a user while said panel is positioned against a back of the user such that said panel supports the back of the user in an upright seated position.

2. The assembly of claim 1, further comprising said cord being a shock cord wherein a length of said cord being resilient and stretchable.

3. The assembly of claim 1, further comprising a pair of loops coupled to said panel, each of said loops being coupled to and extending away from an associated one of said respective ends of said panel, each of said first end and said second end of said cord being coupled to an associated one of said loops.

4. The assembly of claim 3, further comprising:

each of said loops having a respective aperture extending therethrough;

said cord extending through said aperture in each of said loops, said first end of said cord and said second end of said cord each being knotted wherein each of said first end and said second end of said cord are inhibited from passing through an associated one of said apertures whereby said cord is coupled to said panel.

5. The assembly of claim 4, further comprising a pair of grommets, each of said grommets being coupled to an associated one of said loops such that each said grommet reinforces a perimeter edge extending around said aperture extending through said associated loop.

6. The assembly of claim 1, further comprising a cord lock coupled to said cord wherein an effective length of said cord extending between said opposite ends of said panel is adjustable.

7. The assembly of claim 6, further comprising said cord lock being a tab having a pair of spaced holes, said cord extending through said spaced holes such that said tab engages a pair of spaced points on said cord wherein a section of said cord extending between said spaced holes is removable from said effective length of said cord extending between said opposite ends of said panel.

8. The assembly of claim 1, further comprising a pair of clips, each said clip being coupled to an associated one of said foot straps opposite said looped end wherein said clips are positioned to secure said foot straps to said panel.

9. The assembly of claim 1, further comprising each of said foot straps having an adjustable length.

10. The assembly of claim 1, further comprising a pocket coupled to said panel.

11. The assembly of claim 10, further comprising each of said foot straps being positionable in said pocket for storage of said foot straps when not in use.

12. A paddleboard seat support assembly comprising:

a panel;

a cord having a first end and a second end, each of said first end and said second end being coupled to a respective end of said panel, said cord being a shock cord wherein a length of said cord being resilient and stretchable;

a pair of foot straps, each foot strap having a respective looped end, each of said foot straps being couplable to said panel such that looped ends of said foot straps are positioned in spaced relationship to said panel wherein said looped ends of said foot straps are configured for engaging feet of a user while said panel is positioned against a back of the user such that said panel supports the back of the user in an upright seated position, each of said foot straps having an adjustable length;

a pair of clips, each said clip being coupled to an associated one of said foot straps opposite said looped end wherein said clips are positioned to secure said foot straps to said panel;

a pair of loops coupled to said panel, each of said loops being coupled to and extending away from an associated one of said respective ends of said panel, each of said first end and said second end of said cord being coupled to an associated one of said loops, each of said loops having a respective aperture extending therethrough, said cord extending through said aperture in each of said loops, said first end of said cord and said second end of said cord each being knotted wherein each of said first end and said second end of said cord are inhibited from passing through an associated one of said apertures whereby said cord is coupled to said panel;

a pair of grommets, each of said grommets being coupled to an associated one of said loops such that each said grommet reinforces a perimeter edge extending around said aperture extending through said associated loop;

a cord lock coupled to said cord wherein an effective length of said cord extending between said opposite ends of said panel is adjustable, said cord lock being a tab having a pair of spaced holes, said cord extending through said spaced holes such that said tab engages a pair of spaced points on said cord wherein a section of said cord extending between said spaced holes is removable from said effective length of said cord extending between said opposite ends of said panel; and a pocket coupled to said panel, each of said foot straps being positionable in said pocket for storage of said foot straps when not in use.

* * * * *